US009845683B2

(12) United States Patent
Lamb, Jr.

(10) Patent No.: US 9,845,683 B2
(45) Date of Patent: Dec. 19, 2017

(54) GAS TURBINE ENGINE ROTOR BLADE

(71) Applicant: United Technologies Corporation, Hartford, CT (US)

(72) Inventor: Donald William Lamb, Jr., North Haven, CT (US)

(73) Assignee: United Technology Corporation, Farmington, CT (US)

( * ) Notice: Subject to any disclaimer, the term of this patent is extended or adjusted under 35 U.S.C. 154(b) by 981 days.

(21) Appl. No.: 13/736,100

(22) Filed: Jan. 8, 2013

(65) Prior Publication Data

US 2014/0245753 A1 Sep. 4, 2014

(51) Int. Cl.

| | |
|---|---|
| ***F01D 5/14*** | (2006.01) |
| ***F01D 5/20*** | (2006.01) |
| ***F04D 29/32*** | (2006.01) |
| ***F04D 29/38*** | (2006.01) |

(52) U.S. Cl.

CPC ..... *F01D 5/14* (2013.01); *F01D 5/20* (2013.01); *F04D 29/324* (2013.01); *F04D 29/386* (2013.01); *F05D 2250/70* (2013.01)

(58) Field of Classification Search

CPC . F01D 5/141; F01D 5/14; F01D 5/145; F01D 5/20; F04D 29/324; F04D 29/384; F04D 29/386

USPC ..... 416/228, 235, 236 R, 237, 238, DIG. 2, 416/DIG. 5, 223 A; 415/173.1

See application file for complete search history.

(56) References Cited

U.S. PATENT DOCUMENTS

| | | | | |
|---|---|---|---|---|
| 971,409 | A * | 9/1910 | Roggenbuck | 416/237 |
| 1,146,121 | A * | 7/1915 | Amnelius | 416/237 |
| 1,828,409 | A | 10/1931 | Densmore | |
| 3,706,512 | A * | 12/1972 | Strelshik | F04D 29/324 416/194 |
| 4,161,318 | A | 7/1979 | Stuart et al. | |
| 4,880,355 | A | 11/1989 | Vuillet et al. | |
| 4,979,698 | A | 12/1990 | Lederman | |
| 5,137,427 | A | 8/1992 | Shenoy | |
| 5,234,318 | A | 8/1993 | Brandon | |
| 5,332,362 | A | 7/1994 | Toulmay et al. | |
| 5,393,199 | A | 2/1995 | Alizadeh | |
| 5,685,696 | A | 11/1997 | Zangeneh et al. | |
| 5,957,661 | A | 9/1999 | Hunt et al. | |
| 5,992,793 | A | 11/1999 | Perry et al. | |
| 6,142,738 | A * | 11/2000 | Toulmay | B64C 27/463 416/223 R |

(Continued)

FOREIGN PATENT DOCUMENTS

| | | |
|---|---|---|
| DE | 560589 C | 10/1932 |
| GB | 1231424 | 5/1971 |

(Continued)

OTHER PUBLICATIONS

International Search Report for PCT Application No. PCT/US2014/010175 dated May 9, 2014.

(Continued)

*Primary Examiner* — Christopher Verdier

(74) *Attorney, Agent, or Firm* — Carlson, Gaskey & Olds

(57) ABSTRACT

A rotor blade for a gas turbine engine according to an exemplary aspect of the present disclosure includes, among other things, an airfoil extending in span between a root region and a tip region and a tip portion extending at an angle from the tip region of the airfoil.

20 Claims, 6 Drawing Sheets

(56) References Cited

U.S. PATENT DOCUMENTS

| | | | | |
|---|---|---|---|---|
| 6,565,324 | B1 * | 5/2003 | Phillipsen et al. | 416/236 R |
| 6,899,526 | B2 | 5/2005 | Doloresco et al. | |
| 6,901,873 | B1 | 6/2005 | Lang et al. | |
| 6,976,829 | B2 | 12/2005 | Kovalsky et al. | |
| 7,207,526 | B2 | 4/2007 | McCarthy | |
| 7,246,998 | B2 | 7/2007 | Kovalsky et al. | |
| 7,252,479 | B2 | 8/2007 | Bagai et al. | |
| 7,264,200 | B2 | 9/2007 | Bussom et al. | |
| 7,726,937 | B2 | 6/2010 | Baumann et al. | |
| 7,967,571 | B2 | 6/2011 | Wood et al. | |
| 8,147,207 | B2 | 4/2012 | Orosa et al. | |
| 8,167,567 | B2 | 5/2012 | Kirchner et al. | |
| 2005/0220627 | A1 * | 10/2005 | Goodman | 416/235 |
| 2008/0213098 | A1 * | 9/2008 | Neef et al. | 416/223 A |
| 2009/0252602 | A1 | 10/2009 | Diakunchak | |
| 2009/0269189 | A1 | 10/2009 | Bottome | |
| 2011/0002777 | A1 | 1/2011 | Smith | |
| 2011/0091327 | A1 | 4/2011 | Willett, Jr. | |
| 2012/0063909 | A1 * | 3/2012 | Bottome | F01D 5/14 416/228 |

FOREIGN PATENT DOCUMENTS

| | | |
|---|---|---|
| GB | 1491556 | 11/1977 |
| GB | 2050530 A | 1/1981 |
| JP | H0452505 U | 5/1992 |

OTHER PUBLICATIONS

International Preliminary Report on Patentability for PCT Application No. PCT/US2014/010175, dated Jul. 23, 2015.
Extended European Search Report for Application No. EP 14 73 7978 dated Jul. 26, 2016.

* cited by examiner

GAS TURBINE ENGINE ROTOR BLADE

BACKGROUND

This disclosure relates to a gas turbine engine, and more particularly to a rotor blade for a gas turbine engine that provides improved aerodynamic performance.

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Some gas turbine engines sections may utilize multiple stages to obtain the pressure levels necessary to achieve desired thermodynamic cycle goals. For example, the compressor and turbine sections of a gas turbine engine typically include alternating rows of moving airfoils (i.e., rotor blades) and stationary airfoils (i.e., stator vanes). Each stage consists of a row of rotor blades and a row of stator vanes.

One design feature of a rotor blade that can affect gas turbine engine performance is the airflow gap that extends between the tips of each rotor blade and a surrounding shroud assembly or engine casing. Airflow that escapes through these gaps can result in gas turbine engine performance losses.

SUMMARY

A rotor blade for a gas turbine engine according to an exemplary aspect of the present disclosure includes, among other things, an airfoil extending in span between a root region and a tip region and a tip portion extending at an angle from the tip region of the airfoil.

In a further non-limiting embodiment of the foregoing rotor blade, a span axis of the tip portion forms a dihedral angle relative to a span axis of the airfoil.

In a further non-limiting embodiment of either of the foregoing rotor blades, the dihedral angle is greater than or equal to 90° relative to the span axis of the airfoil.

In a further non-limiting embodiment of any of the foregoing rotor blades, the dihedral angle is less than or equal to 90° relative to the span axis of the airfoil.

In a further non-limiting embodiment of any of the foregoing rotor blades, the dihedral angle is between 45° and 135° degrees relative to the span axis of the airfoil.

In a further non-limiting embodiment of any of the foregoing rotor blades, the tip portion extends from a pressure side of the airfoil.

In a further non-limiting embodiment of any of the foregoing rotor blades, the tip portion extends in span between a root and a tip and extends in chord between a leading edge and a trailing edge, and the tip portion defines a plurality of cross-sectional slices that extend between the leading edge and the trailing edge along the span of the tip portion.

In a further non-limiting embodiment of any of the foregoing rotor blades, the tip portion is not tapered between the root and the tip of the tip portion.

In a further non-limiting embodiment of any of the foregoing rotor blades, the tip portion includes a converging taper between the root and the tip of the tip portion.

In a further non-limiting embodiment of any of the foregoing rotor blades, the tip portion includes a diverging taper between the root and the tip of the tip portion.

In a further non-limiting embodiment of any of the foregoing rotor blades, the tip portion forms a sweep angle that is defined between a chord axis and a span axis of the tip portion.

In a further non-limiting embodiment of any of the foregoing rotor blades, the tip portion includes an aft sweep.

In a further non-limiting embodiment of any of the foregoing rotor blades, the tip portion includes a forward sweep.

In a further non-limiting embodiment of any of the foregoing rotor blades, the tip portion defines a sweep angle and a dihedral angle that extend across an entire span of the tip portion.

In a further non-limiting embodiment of any of the foregoing rotor blades, a tip of the tip portion is rotated in a direction toward the root region.

In a further non-limiting embodiment of any of the foregoing rotor blades, a tip of the tip portion is rotated in a direction away from the root region.

A gas turbine engine according to an exemplary aspect of the present disclosure includes, among other things, a compressor section, a combustor section in fluid communication with the compressor section and a turbine section in fluid communication the combustor section. A plurality of rotor blades positioned within at least one of the compressor section and the turbine section, and each of the plurality of rotor blades includes an airfoil extending in span between a root region and a tip region and a tip portion extending at an angle from the tip region of the airfoil.

In a further non-limiting embodiment of the foregoing gas turbine engine, the plurality of rotor blades are at least partially radially surrounded by a shroud assembly.

In a further non-limiting embodiment of either of the foregoing gas turbine engines, the tip portion includes a dihedral angle and a sweep angle that extend across an entire span of the tip portion.

The various features and advantages of this disclosure will become apparent to those skilled in the art from the following detailed description. The drawings that accompany the detailed description can be briefly described as follows.

DETAILED DESCRIPTION

Figure 1:
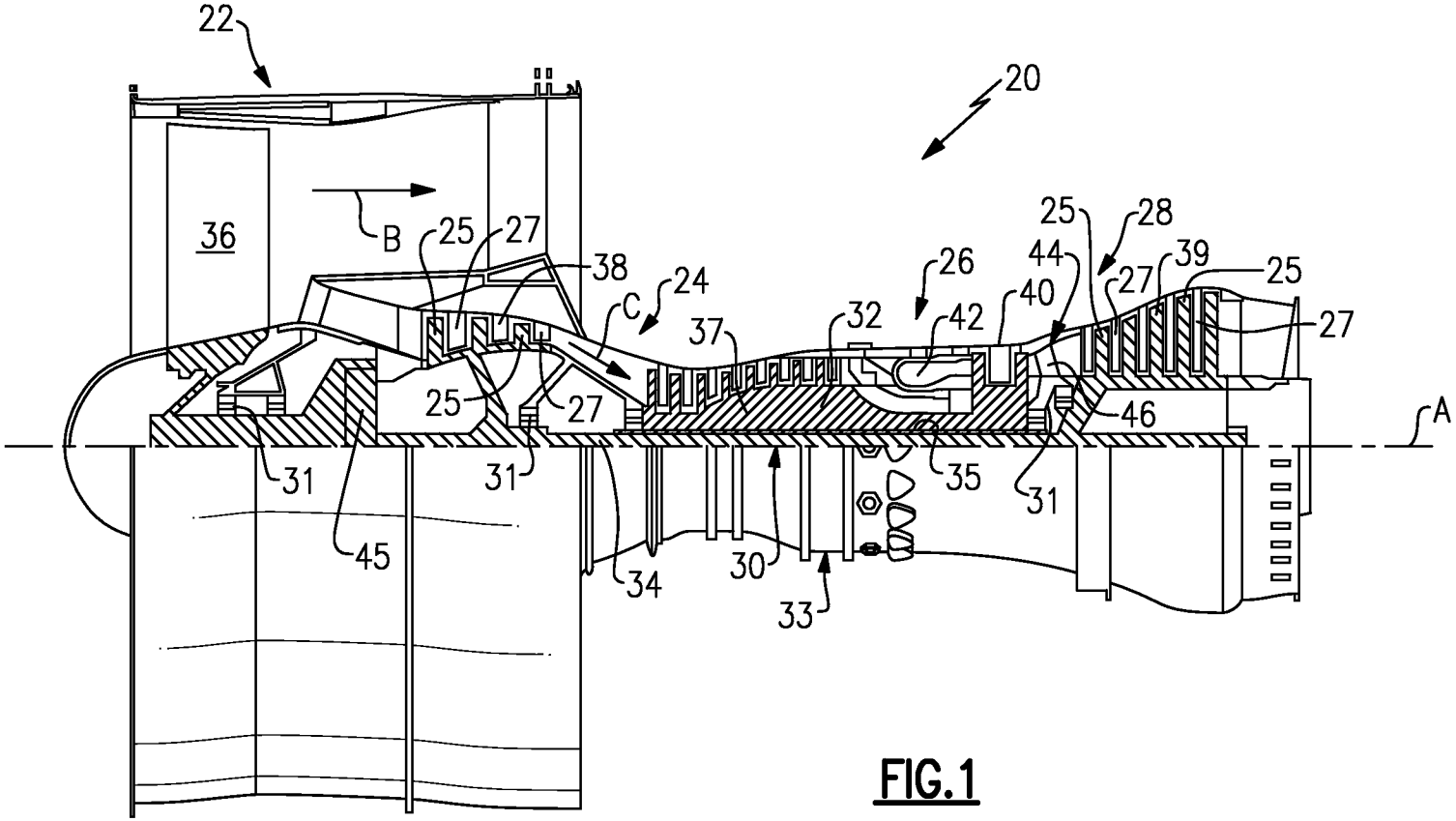
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In one embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram } °R)/(518.7°R)]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotor blades 25, while each vane assembly can carry a plurality of vanes 27 that extend into the core flow path C.

Figure 2:
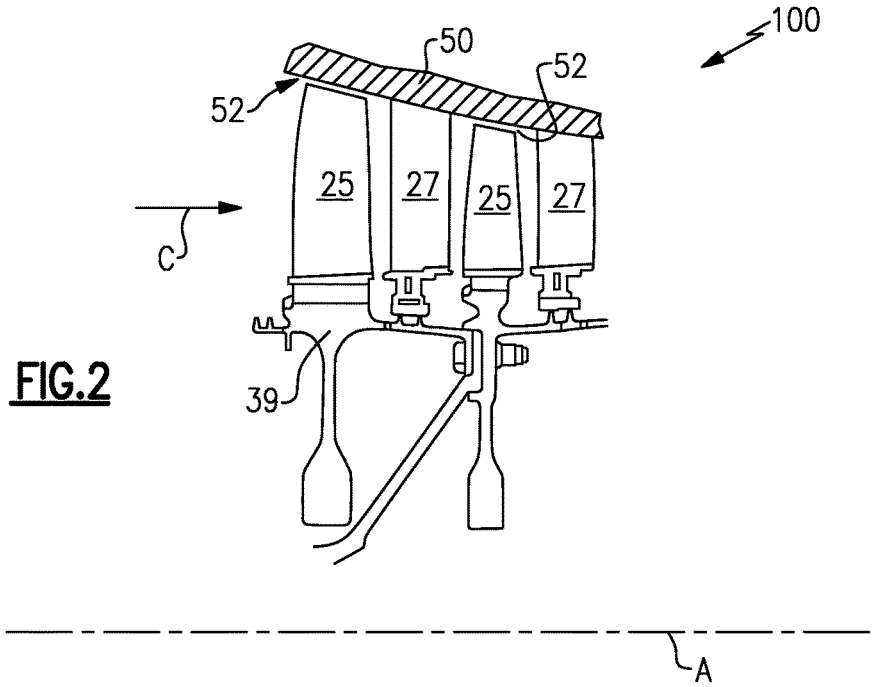
FIG. 2 illustrates a portion of a gas turbine engine.

FIG. 2 schematically illustrates a portion 100 of a gas turbine engine, such as the gas turbine engine 20 of FIG. 1. The portion 100 may be representative of a section of either the compressor section 24 or the turbine section 28 of the gas turbine engine 20. The portion 100 includes a plurality of stages that each include alternating rows of rotor blades 25 and stator vanes 27. Although two stages are illustrated by FIG. 2, it should be understood that the portion 100 could include a greater or fewer number of stages.

The rotor blades 25 rotate about the engine centerline longitudinal axis A in a known manner to either create or extract energy (in the form of pressure) from the core airflow that is communicated through the gas turbine engine 20 along the core flow path C. The stator vanes 27 convert the velocity of airflow into pressure, and turn the airflow in a desired direction to prepare the airflow for the next set of rotor blades 25.

The rotor blades 25 are at least partially radially surrounded by a shroud assembly 50 (i.e., an outer casing of the engine static structure 33 of FIG. 1). A gap 52 can extend between each rotor blade 25 and the shroud assembly 50 to provide clearance for accommodating the rotation of the rotor blades 30.

Figure 3:
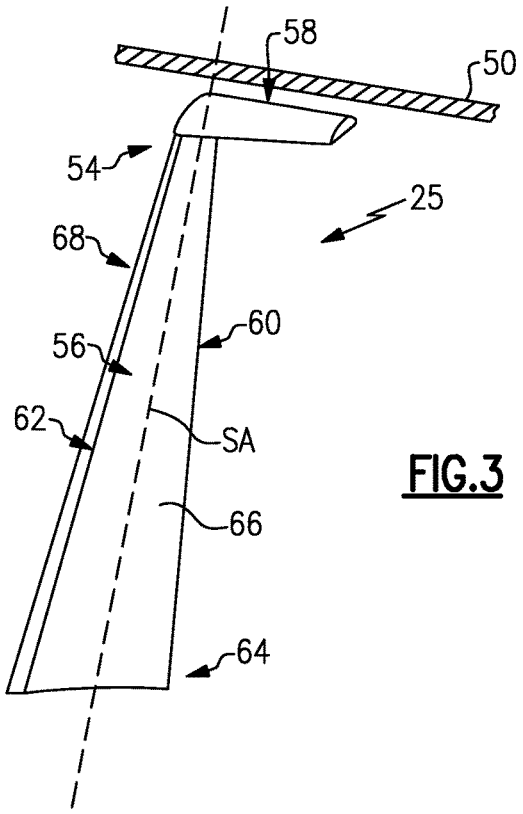
FIG. 3 illustrates an exemplary rotor blade that can be incorporated into a gas turbine engine.

FIG. 3 illustrates an exemplary rotor blade 25 that can be incorporated into a gas turbine engine. For example, one or more rotor blades of the compressor section 24 and/or the turbine section 28 of the gas turbine engine 20 may include a design similar to the exemplary rotor blade 25. The teachings of this disclosure could also extend to other portions of a gas turbine engine 20. The rotor blade 25 can include one or more design characteristics that provide improved aerodynamic performance, thereby improving gas turbine engine performance.

In this exemplary embodiment, the rotor blade 25 includes an airfoil 56 that axially extends in chord between a leading edge portion 60 and a trailing edge portion 62. The airfoil 56 also extends in span across a span axis SA between a root region 64 and a tip region 54. The airfoil 56 may also circumferentially extend between a pressure side 66 and a suction side 68.

A tip portion 58 may extend from the airfoil 56 of the rotor blade 25. In one embodiment, the tip portion 58 extends from the tip region 54 at an angle relative to the airfoil 56.

In this embodiment, the tip portion 58 extends from the pressure side 66 of the airfoil 56. That is, the tip portion 58 only extends from a single side of the airfoil 56. The tip portion 58 may extend from the airfoil 56 such that it is parallel to the shroud assembly 50, which radially surrounds the rotor blade 25.

Although not shown in FIG. 3, the rotor blade 25 may also include platform and root portions for attaching the rotor blade 25 to a rotor disk (see feature 39 of FIG. 2, for example).

Figure 4A:
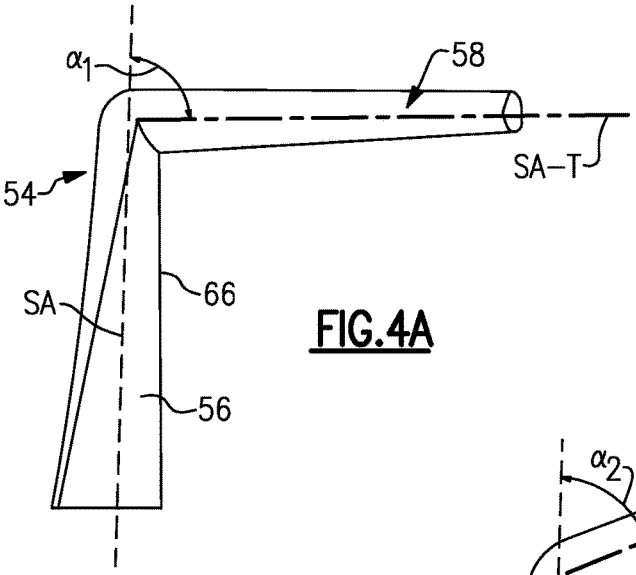
FIGS. 4A, 4B and 4C illustrate a tip portion of a rotor blade.
Figure 4B:
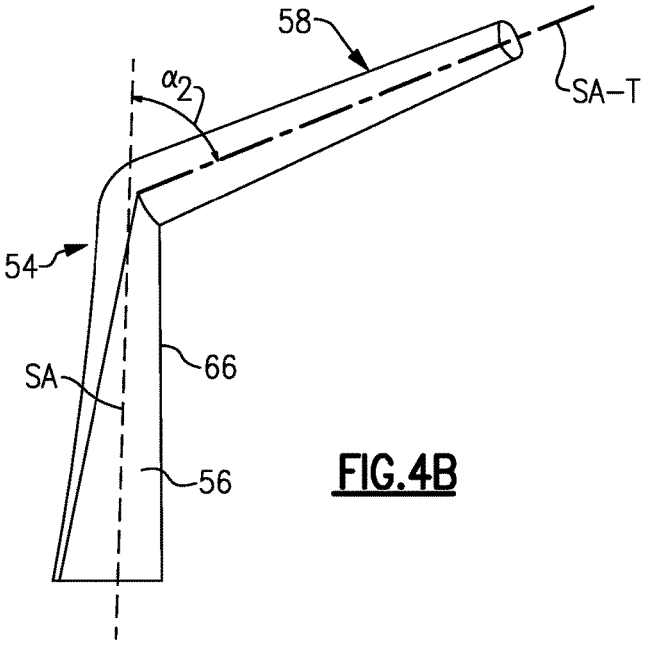
Figure 4C:
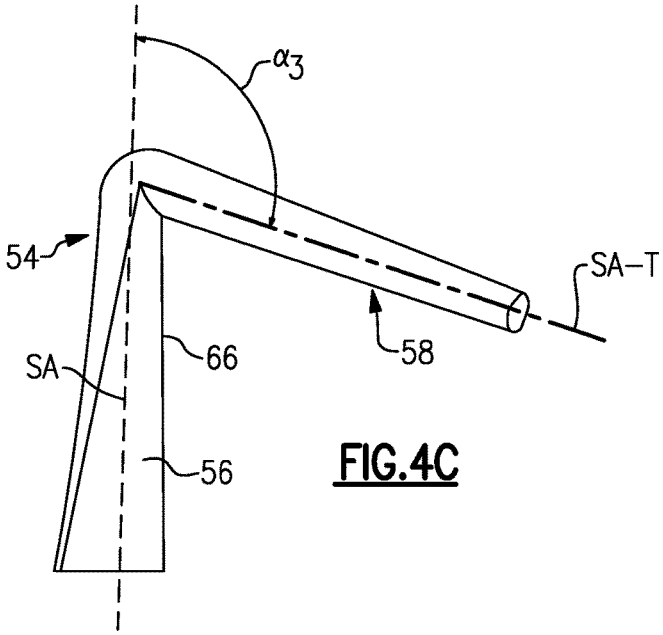

FIGS. 4A, 4B and 4C illustrate the tip portion 58 of the rotor blade 25 of FIG. 3. The tip portion 58 can form a dihedral angle $\alpha$ relative to a span axis SA of the airfoil 56.

In one embodiment, the tip portion 58 forms a dihedral angle $\alpha_1$ that is 90° relative to the span axis SA (see FIG. 4A). In other words, the tip portion 58 can extend across a span axis SA-T that is perpendicular to the span axis SA of the airfoil 56. In another embodiment, the tip portion 58 forms a dihedral angle $\alpha_2$ is less than 90° relative to the span axis SA (see FIG. 4B). The tip portion 58 could also form a dihedral angle $\alpha_3$ that is greater than 90° relative to the span axis SA (see FIG. 4C). In yet another embodiment, the dihedral angle is between 45° and 135° relative to the span axis SA of the airfoil 56.

Figure 5A:
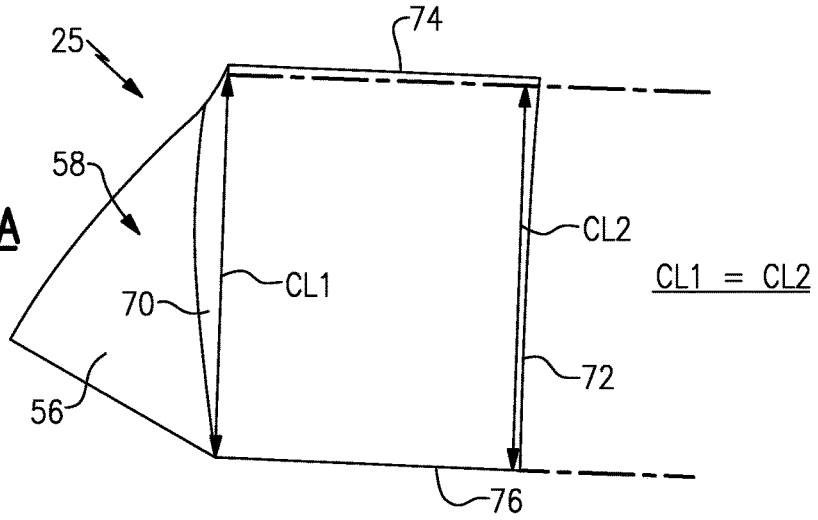
FIGS. 5A, 5B and 5C illustrate various design characteristics that can be incorporated into a tip portion of a rotor blade.
Figure 5B:
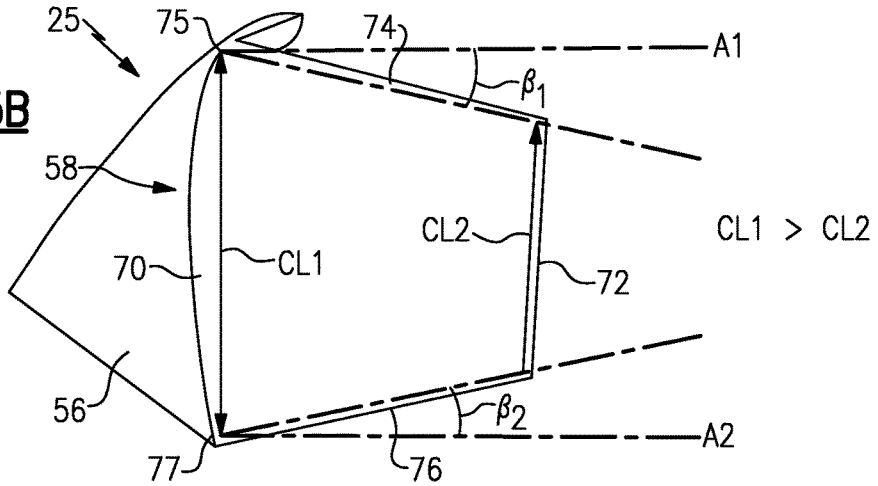
Figure 5C:
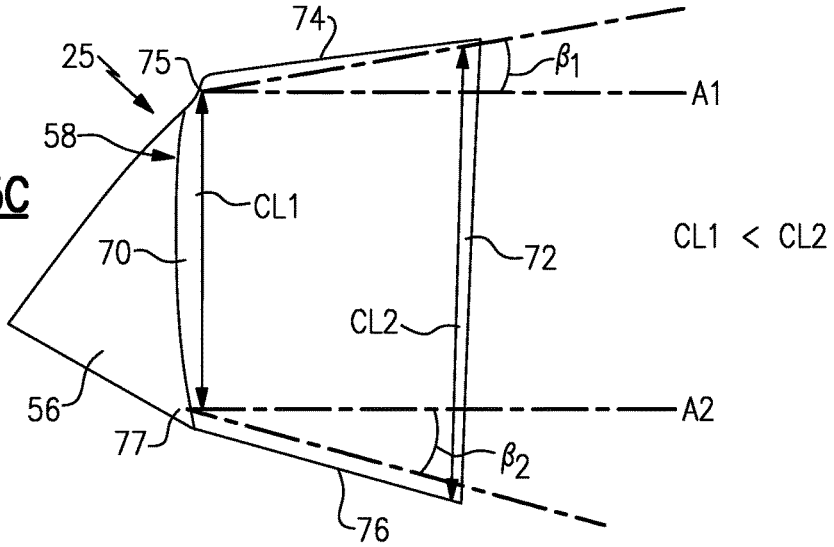

FIGS. 5A, 5B and 5C illustrate possible variations in the chord length over the span of a tip portion 58 of a rotor blade 25. The tip portion 58 extends in span between a root 70 (near the airfoil 56) and a tip 72 (spaced from the airfoil 56) and extends in chord between a leading edge 74 and a trailing edge 76. A plurality of cross-sectional chord slices CL extend between the leading edge 74 and the trailing edge 76 across the span between the root 70 and tip 72.

FIG. 5A illustrates one possible configuration that can be embodied by the tip portion 58. In this embodiment, the tip portion 58 is not tapered between the root 70 and the tip 72. In other words, a chord CL1 that extends through the root 70 (between the leading edge 74 and the trailing edge 76) is the same length as a chord CL2 that extends through the tip 72 (between the leading edge 74 and the trailing edge 76).

In another embodiment, the tip portion 58 includes a converging taper between the root 70 and the tip 72. In other words, as shown in FIG. 5B, a chord CL1 that extends through the root 70 can include greater length than a chord CL2 that extends through the tip 72. A converging taper such as illustrated by FIG. 5B defines taper angles $\beta_1$, $\beta_2$ relative to reference axes A1, A2 that extend axially through a leading edge 75 and a trailing edge 77 of the root 70. The taper angles $\beta_1$, $\beta_2$ may be the same or different angles. In this configuration, the leading edge 74 of the tip portion 58 extends toward the trailing edge 76 of the tip portion 58 and the trailing edge 76 extends toward the leading edge 74 to define the converging taper.

FIG. 5C illustrates a tip portion 58 having a diverging taper between the root 70 and the tip 72. The diverging taper establishes a larger chord CL2 at the tip 72 as compared to a chord CL1 that extends through the root 70. The diverging taper illustrated by FIG. 5C defines taper angles $\beta_1$, $\beta_2$ relative to reference axes A1, A2 that extend axially from the leading edge 75 and trailing edge 77 of the root 70. In this configuration, the leading edge 74 of the tip portion 58 extends away from the trailing edge 76 and the trailing edge 76 extends away from the leading edge 74 to define the diverging taper. The taper angles $\beta_1$, $\beta_2$ may be the same or different angles.

Figure 6A:
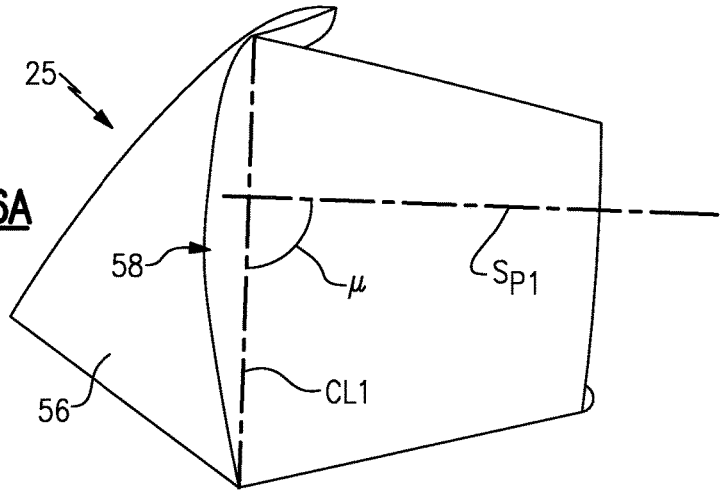
FIGS. 6A, 6B and 6C illustrate additional design characteristics of a rotor blade tip portion.
Figure 6B:
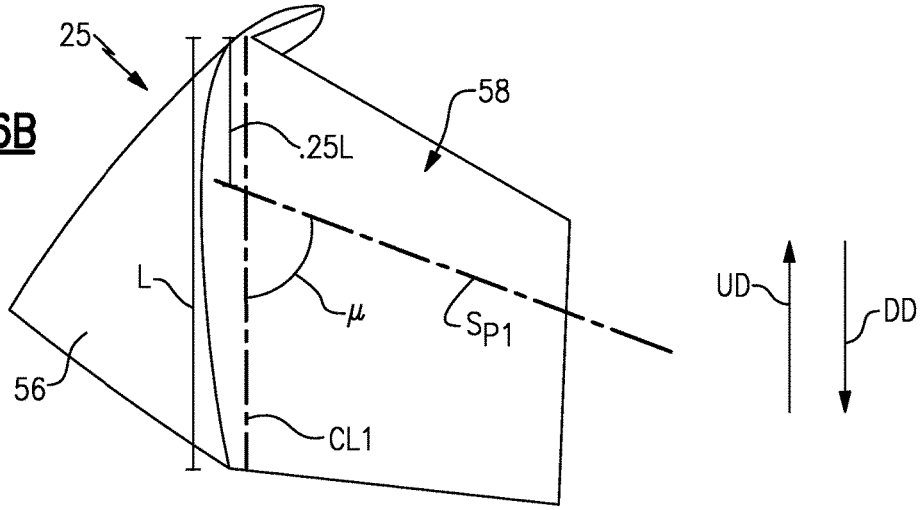
Figure 6C:
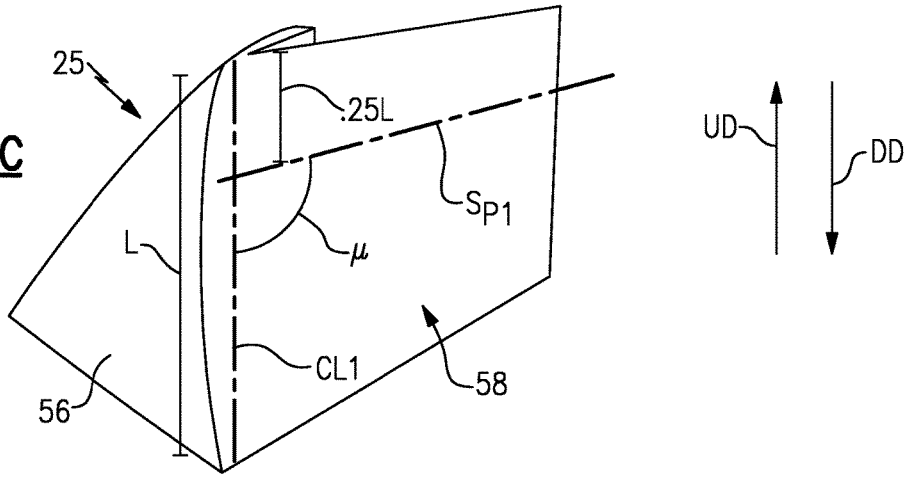

FIGS. 6A, 6B and 6C illustrate additional design features that can be incorporated into a tip portion 58 of a rotor blade 25. For example, the tip portion 58 can also form a sweep angle $\mu$. The sweep angle $\beta_1$, $\beta_2$ is defined between a chord axis CL1 and a span axis SP1 of the tip portion 58. In one non-limiting embodiment, the span axis SP1 intersects the chord axis CL1 at 25% of the length of the chord axis CL1 between the leading edge 74 and the trailing edge 76.

The tip portion 58 can include no sweep (see FIG. 6A), an aft sweep (see FIG. 6B) or a forward sweep (see FIG. 6C). The aft sweep extends in a downstream direction DD relative to the airfoil 56 (i.e., toward the trailing edge 62). A forward sweep extends in an upstream direction UD relative to the airfoil 56 (i.e., toward the leading edge 60).

Figure 7A:
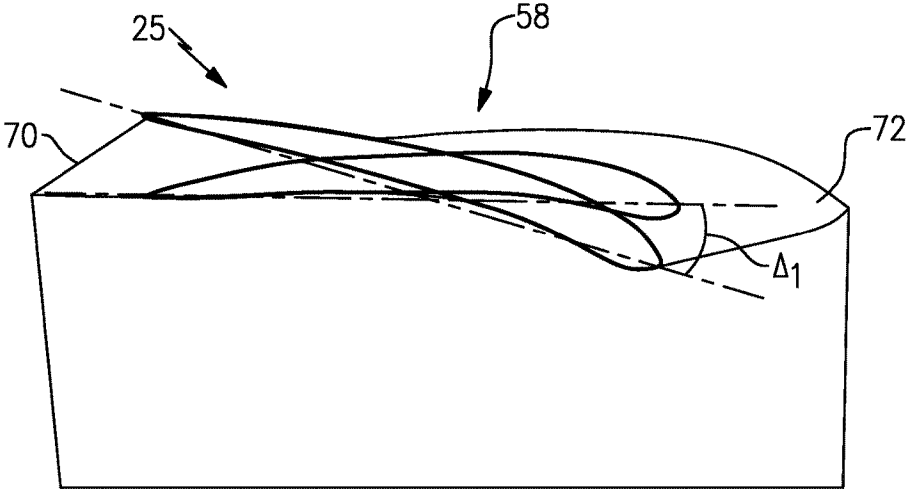
FIGS. 7A and 7B illustrate other design features that can be incorporated into a tip portion of a rotor blade.
Figure 7B:
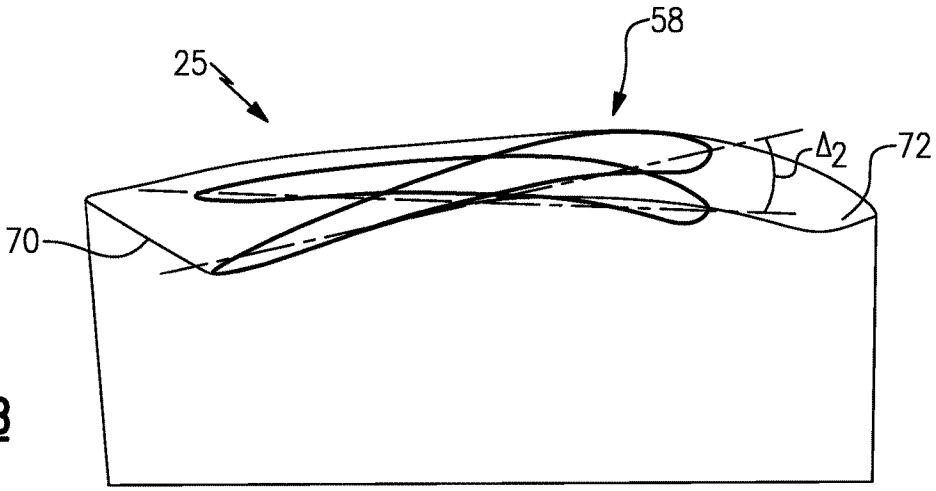

FIGS. 7A and 7B illustrate additional characteristics that can be designed into the tip portion 58 of a rotor blade 25. The tip portion 58 may include an airfoil tip rotation. As shown in FIG. 7A, the tip 72 of the tip portion 58 may be rotated by an angle $\Delta_1$ toward the root region 64 (see FIG. 3) of the airfoil 56. Alternatively, as shown in FIG. 7B, the tip 72 of the tip portion 58 can be rotated by an angle $\Delta_2$ in a direction away from the root region 64. In other words, the tip 72 of the tip portion 58 can include a nose down or a nose up configuration.

Although the design characteristics described above and illustrated in FIGS. 4, 5A, 5B, 5C, 6A, 6B, 6C, 7A and 7B of this application are shown individually, it should be understood that any given tip portion of a rotor blade can include any combination of these design configurations. For example, one exemplary rotor blade can include a tip portion having a dihedral angle that is greater than 90°, a converging taper, no sweep and a nose down configured tip. In another configuration, a tip portion of a rotor blade can include a normal dihedral angle, a diverging taper, forward sweep and no tip rotation. It should be understood that the specific design characteristics for any given rotor blade can vary depending upon design specific parameters, including but not limited to, the aerodynamic and performance requirements of a gas turbine engine.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A rotor blade for a gas turbine engine, comprising:

an airfoil extending along a span axis between a root region and a tip region, said airfoil extending from a platform;

a tip portion extending at an angle from a pressure side of said tip region of said airfoil; and said tip portion forming a uniform sweep angle that is defined between a chord axis and a span axis of said tip portion, said chord axis extending between a leading edge and a trailing edge of said tip portion and said span axis extending between a root of said tip portion that is located near said airfoil and a tip of said tip portion that is spaced from said airfoil, and said tip portion includes either an aft sweep or a forward sweep such that said span axis of said tip portion is non-orthogonal relative to said chord axis of said tip portion and each of said leading edge and said trailing edge of said tip portion are swept in the same direction.

2. The rotor blade as recited in claim 1, wherein said span axis of said tip portion forms a dihedral angle relative to said span axis of said airfoil.

3. The rotor blade as recited in claim 2, wherein said dihedral angle is greater than 90° relative to said span axis of said airfoil.

4. The rotor blade as recited in claim 2, wherein said dihedral angle is less than 90° relative to said span axis of said airfoil.

5. The rotor blade as recited in claim 2, wherein said dihedral angle is between 45° and 135° degrees relative to said span axis of said airfoil.

6. The rotor blade as recited in claim 1, wherein said tip portion defines a plurality of cross-sectional slices that extend between said leading edge and said trailing edge along said span of said tip portion.

7. The rotor blade as recited in claim 6, wherein said tip portion is not tapered between said root and said tip of said tip portion.

8. The rotor blade as recited in claim 6, wherein said tip portion includes a converging taper between said root and said tip of said tip portion.

9. The rotor blade as recited in claim 6, wherein said tip portion includes a diverging taper between said root and said tip of said tip portion.

10. The rotor blade as recited in claim 1, wherein said tip portion defines said sweep angle and a dihedral angle that extend across an entire span of said tip portion.

11. The rotor blade as recited in claim 1, wherein a tip of said tip portion is rotated in a direction toward said root region.

12. The rotor blade as recited in claim 1, wherein a tip of said tip portion is rotated in a direction away from said root region.

13. The rotor blade as recited in claim 1, wherein said tip portion includes a diverging taper, said forward sweep and no tip rotation.

14. The rotor blade as recited in claim 1, wherein said tip portion includes a converging taper and a dihedral angle greater than 90°.

15. A rotor blade for a gas turbine engine, comprising:

an airfoil extending along a span axis between a root region and a tip region;

a tip portion extending at an angle from said tip region of said airfoil;

wherein said tip portion forms a sweep angle that is defined between a chord axis and a span axis of said tip portion, said chord axis extending between a leading edge and a trailing edge of said tip portion and said span axis extending between a root of said tip portion that is located near said airfoil and a tip of said tip portion that is spaced from said airfoil; and wherein said tip portion includes a forward sweep that extends in an upstream direction relative to a positioning of said airfoil within the gas turbine engine such that said span axis of said tip portion is non-orthogonal relative to said chord axis of said tip portion and each of said leading edge and said trailing edge include said forward sweep.

16. A gas turbine engine, comprising:

a compressor section;

a combustor section in fluid communication with said compressor section;

a turbine section in fluid communication with said combustor section;

a plurality of rotor blades positioned within at least one of said compressor section and said turbine section, and each of said plurality of rotor blades includes:

an airfoil extending in span between a root region and a tip region;

a tip portion extending at an angle from a pressure side of said tip region of said airfoil;

said tip portion including a dihedral angle and a sweep angle that extend across an entire span of said tip portion, said sweep angle formed by positioning a span axis of said tip portion at a non-orthogonal angle relative to a chord axis of said tip portion, said chord axis extending between a leading edge and a trailing edge of said tip portion and said span axis extending between a root of said tip portion that is located near said airfoil and a tip of said tip portion that is spaced from said airfoil; and said tip portion including a diverging taper in which said leading edge and said trailing edge diverge away from one another in a direction extending from said root toward said tip of said tip portion.

17. The gas turbine engine as recited in claim 16, wherein said plurality of rotor blades are at least partially radially surrounded by a shroud assembly.

18. The gas turbine engine as recited in claim 16, wherein said dihedral angle is normal to a span axis of said airfoil and said sweep angle is a forward sweep angle.

19. The gas turbine engine as recited in claim 16, wherein said tip portion is rotated either in a direction away from said root region or in a direction toward said root region.

20. The gas turbine engine as recited in claim 16, wherein a first chord length at said root is less than a second chord length at said tip of said tip portion to establish said diverging taper.

* * * * *